US010682852B2

(12) United States Patent
Torigoe

(10) Patent No.: US 10,682,852 B2
(45) Date of Patent: Jun. 16, 2020

(54) RECORDING DEVICE

(71) Applicant: SEIKO EPSON CORPORATION, Tokyo (JP)

(72) Inventor: Yasuhide Torigoe, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/362,405

(22) Filed: Mar. 22, 2019

(65) Prior Publication Data

US 2019/0291425 A1 Sep. 26, 2019

(30) Foreign Application Priority Data

Mar. 23, 2018 (JP) ..... 2018-056579

(51) Int. Cl.
*B41J 2/14* (2006.01)

(52) U.S. Cl.
CPC ..... *B41J 2/14* (2013.01); *B41J 2002/14491* (2013.01); *B41J 2202/20* (2013.01)

(58) Field of Classification Search
CPC ..... B41J 2/14; B41J 2202/20; B41J 2002/14491; B41J 2/175
USPC ..... 347/37, 50
See application file for complete search history.

(56) References Cited

U.S. PATENT DOCUMENTS 6,679,580 B2 * 1/2004 Meados ..... B41J 1/56 347/37
7,681,983 B2 * 3/2010 Kadota ..... B41J 25/304 347/32
8,128,198 B2 * 3/2012 Kemma ..... B41J 3/543 347/37

FOREIGN PATENT DOCUMENTS

JP 2003-110007 A 4/2003
JP 2010-058433 A 3/2010

* cited by examiner

*Primary Examiner* — An H Do
(74) *Attorney, Agent, or Firm* — Workman Nydegger

(57) ABSTRACT

A recording device includes a carriage that is movable in a first and a second direction, a cable, a tube, a cable clamp member that extends from the carriage in a first direction and passes a turned curved portion to extend from the turned curved portion in a second direction, a spring member provided along the cable clamp member, and a clamp member supporting portion extending along the first and the second direction. The spring member is configured to generate spring force in a direction in which hanging down of the cable clamp member at a path portion extending from the carriage to the turned curved portion is suppressed, and the spring member is partially in contact with the clamp member supporting portion at a path portion extending in the second direction from the turned curved portion, in an intersecting direction intersecting the first and the second direction.

9 Claims, 9 Drawing Sheets

RECORDING DEVICE

BACKGROUND

1. Technical Field

The invention relates to a recording device configured to supply an electric signal, ink, or the like to a recording head via wiring or piping that a cable clamp member accommodates.

2. Related Art

As an example of a recording device, an ink jet printer configured to discharge ink onto a recording medium to perform recording is widely used. In such an ink jet printer, wiring through which an electric signal or electric power is transmitted to a recording head, and piping through which the recording head is supplied with a liquid (ink) to be discharged from a nozzle provided in the recording head are coupled to the recording head. In the ink jet printer, when a plurality of color inks are used to perform color image formation, multiple nozzles become necessary, and a plurality of recording heads become necessary.

In the ink jet printer including a plurality of recording heads, the number of lines of the wiring and the piping increases. In ink jet printers, there is an ink jet printer including a clamp member capable of accommodating such a plurality of lines of wiring and piping, and capable of rotatably coupling a plurality of tubular pieces to one another and bending the plurality of tubular pieces to cause the plurality of lines of wiring and piping to follow movement of a carriage (JP-A-2010–58433).

The ink jet printer described in JP-A-2010–58433 includes a clamp member configured to be capable of rotatably coupling a plurality of tubular pieces to one another and bending the plurality of tubular pieces. The clamp member forms a curved portion being curved and turned around, and is formed in a shoe-like shape to be deformable to follow movement of a carriage.

Meanwhile, the clamp member of the ink jet printer described in JP-A-2010–58433 includes a path portion extending from the carriage toward the turned curved portion, and a path portion extending from the curved portion in a direction toward a side on which the carriage is provided. The path portion extending from the curved portion in the direction toward the side on which the carriage is provided is supported by a carriage rail extending along a movement direction of the carriage.

The clamp member accommodates the plurality of lines of wiring and piping. As a result, in the path portion extending from the carriage toward the turned curved portion, a portion of the clamp member tends to hang down owing to weights of these lines of wiring and piping. When a portion of the clamp member hangs down, particularly, a portion of the piping through which a liquid is supplied deforms or collapses to destabilize the supply of the liquid to the recording head, and recording quality on a medium tends to decrease.

On the other hand, the clamp member deforms to follow the movement of the carriage, and the curved portion also moves in the movement direction of the carriage. In this case, a portion of the curved portion comes into contact with the carriage rail in association with the movement of the curved portion, and newly forms a portion of the path portion extending from the curved portion in the direction toward the side on which the carriage is provided. Here, the clamp member constituting a portion of the curved portion generates a contact noise when the clamp member comes into contact with the carriage rail. As a result, when the carriage moves, a noise of contact of the clamp member with the carriage rail is consecutively generated, becoming undesired sound as a running noise of the carriage.

SUMMARY

Hence, an advantage of some aspects of the invention is to provide a recording device capable of reducing a running noise of a carriage while suppressing hanging down of a cable clamp member.

To achieve the above advantage, a recording device according to a first aspect of the invention includes a carriage that includes a recording head configured to discharge a liquid onto a medium to perform recording, and that is movable in a first direction and in a second direction that is a direction opposite to the first direction, a cable through which an electric signal is transmitted to and received from the recording head, a tube through which the liquid is supplied to the recording head, a cable clamp member that is configured to accommodate the cable and the tube and rotatably couple a plurality of tubular pieces to one another to bend the plurality of tubular pieces, that is coupled to the carriage, and that extends from the carriage in the first direction and passes a turned curved portion formed by being curved and turned around to extend from the turned curved portion in the second direction, a spring member provided along the cable clamp member, and a clamp member supporting portion extending along the first direction and the second direction and configured to support the cable clamp member via the spring member. The spring member is configured to generate spring force in a direction in which hanging down of the cable clamp member at a path portion extending from the carriage to the turned curved portion of the cable clamp member is suppressed, and the spring member is partially in contact with the clamp member supporting portion at a path portion extending in the second direction from the turned curved portion, in an intersecting direction intersecting the first direction and the second direction.

According to this aspect, the spring member generates spring force in the direction in which hanging down of the cable clamp member at the path portion extending from the carriage to the turned curved portion in the cable clamp member is suppressed, and thus, when the path portion extending from the carriage to the turned curved portion in the cable clamp member is to hang down, the path portion is retained by the spring force of the spring member, and the hanging down of the path portion can be suppressed.

Further, when the cable clamp member is supported by the clamp member supporting portion, the spring member is partially in contact with the clamp member supporting portion in the intersecting direction intersecting the first direction and the second direction. Accordingly, a shock occurring when the spring member comes into contact with the clamp member supporting portion can be alleviated when the spring member, and in turn, the cable clamp member are supported by the clamp member supporting portion, and a contact noise can be reduced. As a result, a running noise of the carriage can be reduced.

Note that "coupled to the carriage" in this aspect means a configuration in which a member is directly coupled to the carriage, and also means a configuration in which a member is indirectly coupled to the carriage.

According to a second aspect of the invention, in the first aspect, the spring member forms a leaf spring, and a central portion with respect to both end portions in the intersecting direction of the spring member is curved in a direction away from the cable clamp member.

According to this aspect, the spring member forms a leaf spring, and the central portion with respect to both the end portions in the intersecting direction of the spring member is curved in the direction away from the cable clamp member, and thus, the leaf spring is warped in a state where the central portion in the intersecting direction is convex. Therefore, spring force (elastic force) is generated in the spring member, and can act against weights of the cable clamp member and a plurality of lines of wiring and piping, and hanging down of the cable clamp member can be suppressed reliably. Further, when the spring member comes into contact with the clamp member supporting portion, the spring force (elastic force) alleviates a shock occurring when the spring member comes into contact with the clamp member supporting portion, and thus, a contact noise can be reduced more reliably.

Note that "curved" in this aspect means a curved shape in which a central portion draws a gentle curve, and also means a shape bent around a central portion.

According to a third aspect of the invention, in the first or second aspect, the recording device includes a sheet member provided along the spring member in the first direction and in the second direction, and in the recording device, when the cable clamp member is supported by the clamp member supporting portion, the sheet member is located between the spring member and the clamp member supporting portion.

According to this aspect, when the cable clamp member is supported by the clamp member supporting portion, the sheet member is located between the spring member and the clamp member supporting portion, and thus, a shock occurring when the spring member comes into contact with the clamp member supporting portion can be alleviated, and volume of a contact noise can be reduced.

According to a fourth aspect of the invention, in the third aspect, a sheet member retaining portion configured to retain the sheet member is provided at each of both end portions in the intersecting direction of the cable clamp member, and in a state where both end portions in the intersecting direction of the sheet member are retained by the sheet member retaining portion, the sheet member is in contact with the spring member between both the end portions of the sheet member.

According to this aspect, the sheet member is in a state where both the end portions in the intersecting direction of the sheet member are retained by the sheet member retaining portion, and thus, disengagement of the spring member from the cable clamp member can be prevented. In addition, in a state where both the end portions in the intersecting direction of the sheet member are retained by the sheet member retaining portion, the sheet member is in contact with the spring member between both the end portions of the sheet member, and thus, when the cable clamp member is located in the path extending from the carriage to the curved portion, the cable clamp, the cable, and the tube weigh on the spring member via the sheet member. As a result, spring force generated in the spring member can act against weights of the cable clamp, the cable, and the tube to support the cable clamp member, and hanging down of the cable clamp member can be suppressed reliably.

According to a fifth aspect of the invention, in any one of the first to fourth aspects, the clamp member supporting portion is configured to support the cable clamp member at a central portion in the intersecting direction.

According to this aspect, the clamp member supporting portion supports the cable clamp member at the central portion in the intersecting direction, and thus, the clamp member supporting portion can suppress inclination of the cable clamp member to an upstream or downstream side with respect to the clamp member supporting portion in the intersecting direction can be suppressed. As a result, when the carriage moves in the first direction and in the second direction, the cable clamp member is stably supported by the clamp member supporting portion, and contact of a side portion or the like of the cable clamp member with the clamp member supporting portion can be reduced, and generation of undesired sound can be suppressed.

According to a sixth aspect of the invention, in the fifth aspect, a protruding portion protruding toward the cable clamp member is formed at the central portion of the clamp member supporting portion.

According to this aspect, the protruding portion protruding toward the cable clamp member is formed at the central portion of the clamp member supporting portion, and thus, the spring member or the sheet member comes into contact with the protruding portion. As a result, the cable clamp member supported by the clamp member supporting portion, for example, the sheet member retaining portion is supported in a state where the sheet member retaining portion is spaced apart from the clamp member supporting portion. As a result, contact of the cable clamp member with the clamp member supporting portion can be suppressed reliably, and thus, generation of a contact noise between the cable clamp member and the clamp member supporting portion can be prevented.

According to a seventh aspect of the invention, in any one of the first to fifth aspects, at each of both end portions in the intersecting direction of the clamp member supporting portion, a relief portion is formed to avoid contact with the cable clamp member.

According to this aspect, at each of both the end portions in the intersecting direction of the clamp member supporting portion, the relief portion is formed to avoid contact with the cable clamp member, and thus, contact of the clamp member supporting portion with the cable clamp member is avoided, and generation of a contact noise due to contact of the clamp member supporting portion with the cable clamp member can be prevented.

According to an eighth aspect of the invention, in the seventh aspect, a plurality of the relief portions are provided at intervals in the first direction and in the second direction.

According to this aspect, the same effect as in the seventh aspect described above can be obtained.

According to a ninth aspect of the invention, in any one of the first to eighth aspects, the cable clamp member includes a spring member accommodating portion configured to receive the spring member, a convex portion protruding in a direction away from the cable clamp member is formed at a central portion in the intersecting direction of the spring member accommodating portion, and both end portions in the intersecting direction of the convex portion come in contact with the spring member.

According to this aspect, the cable clamp member includes the spring member accommodating portion configured to receive the spring member, the convex portion protruding in the direction away from the cable clamp member is formed at the central portion in the intersecting direction of the spring member accommodating portion, and both the end portions in the intersecting direction of the convex portion come into contact with the spring member, and thus, the spring member can take a posture along the convex portion. Accordingly, spring force can be generated in the spring member. Further, a magnitude of the spring force generated in the spring member can be set in accordance with a distance between both the end portions in the intersecting direction of the convex portion. Accordingly, the distance between both the end portions of the convex portion can be set to cause the spring force commensurate with the weights of the cable clamp member, the cable, and the tube to be generated in the spring member. As a result, hanging down of the cable clamp member can be reduced reliably.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, exemplary embodiments of the invention will be described with reference to the drawings. Note that, in each of the exemplary embodiments, the same configurations are denoted by the same reference signs, and will be described only in the first exemplary embodiment, and the description of such configurations will be omitted in the subsequent exemplary embodiments.

Figure 1:
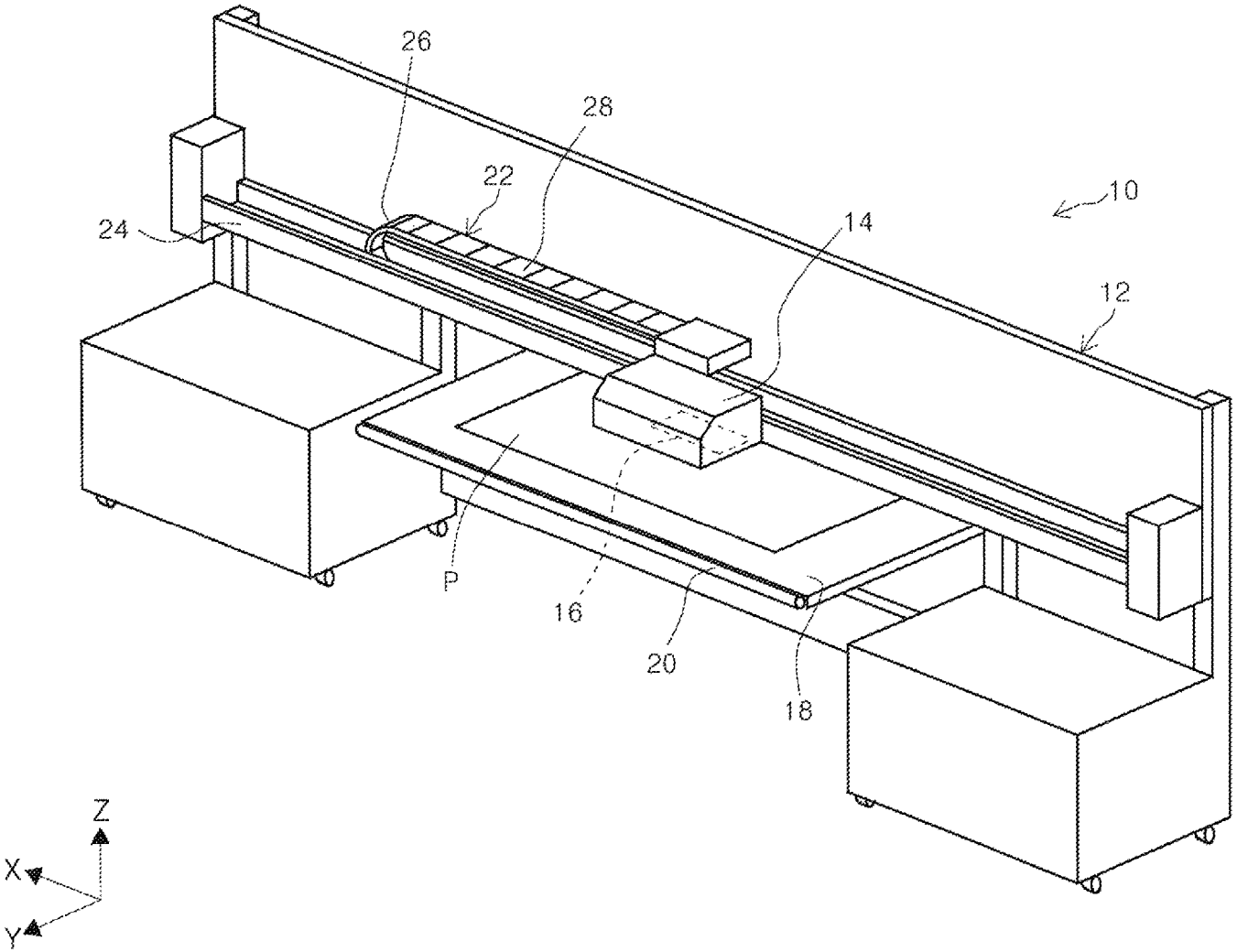
FIG. 1 is a schematic view of a printer according to the invention.
Figure 2:
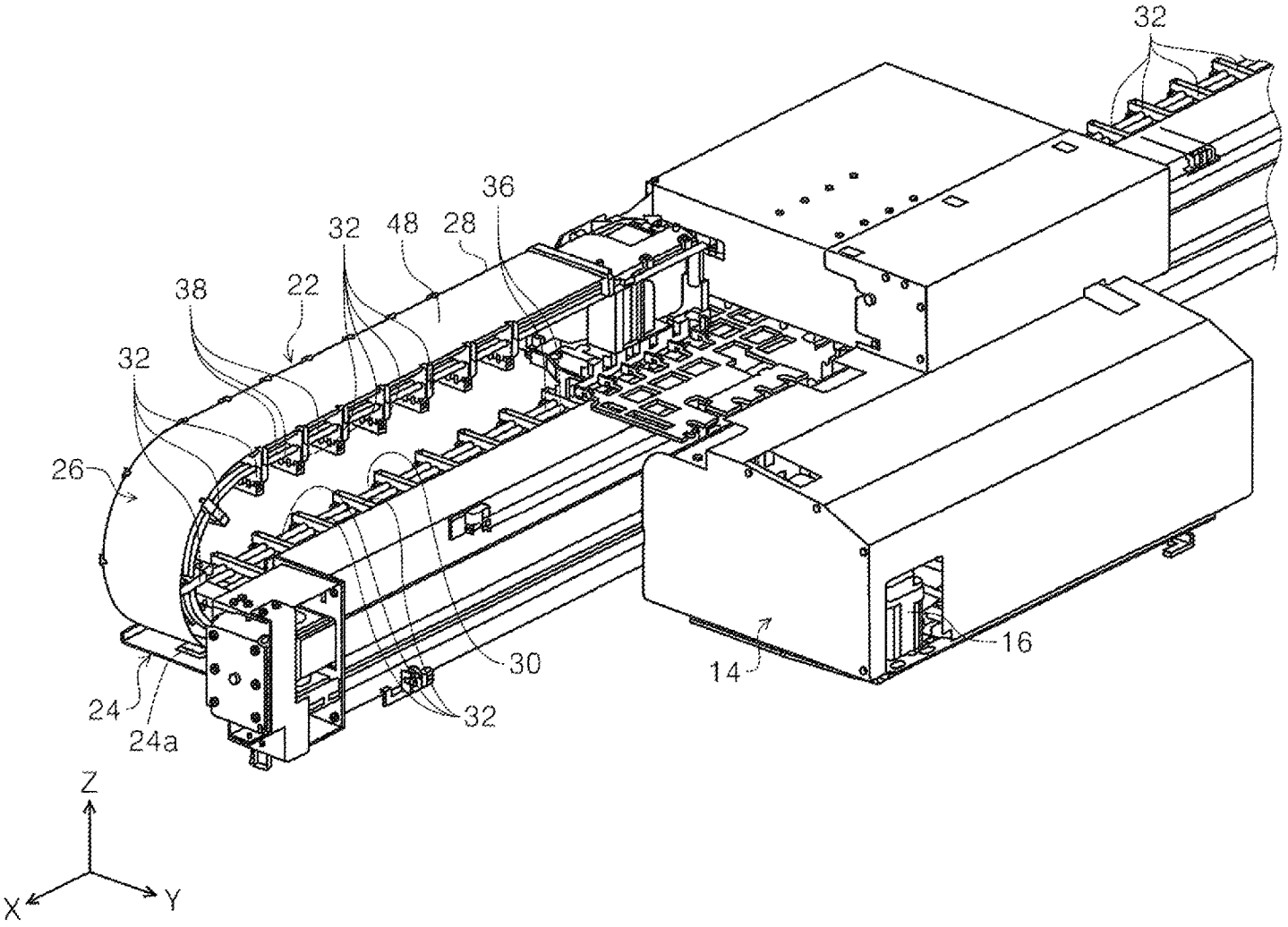
FIG. 2 is a perspective view of a carriage, a cable clamp member, and a clamp member supporting portion according to a first exemplary embodiment as viewed from the front face side in a depth direction of a device.
Figure 3:
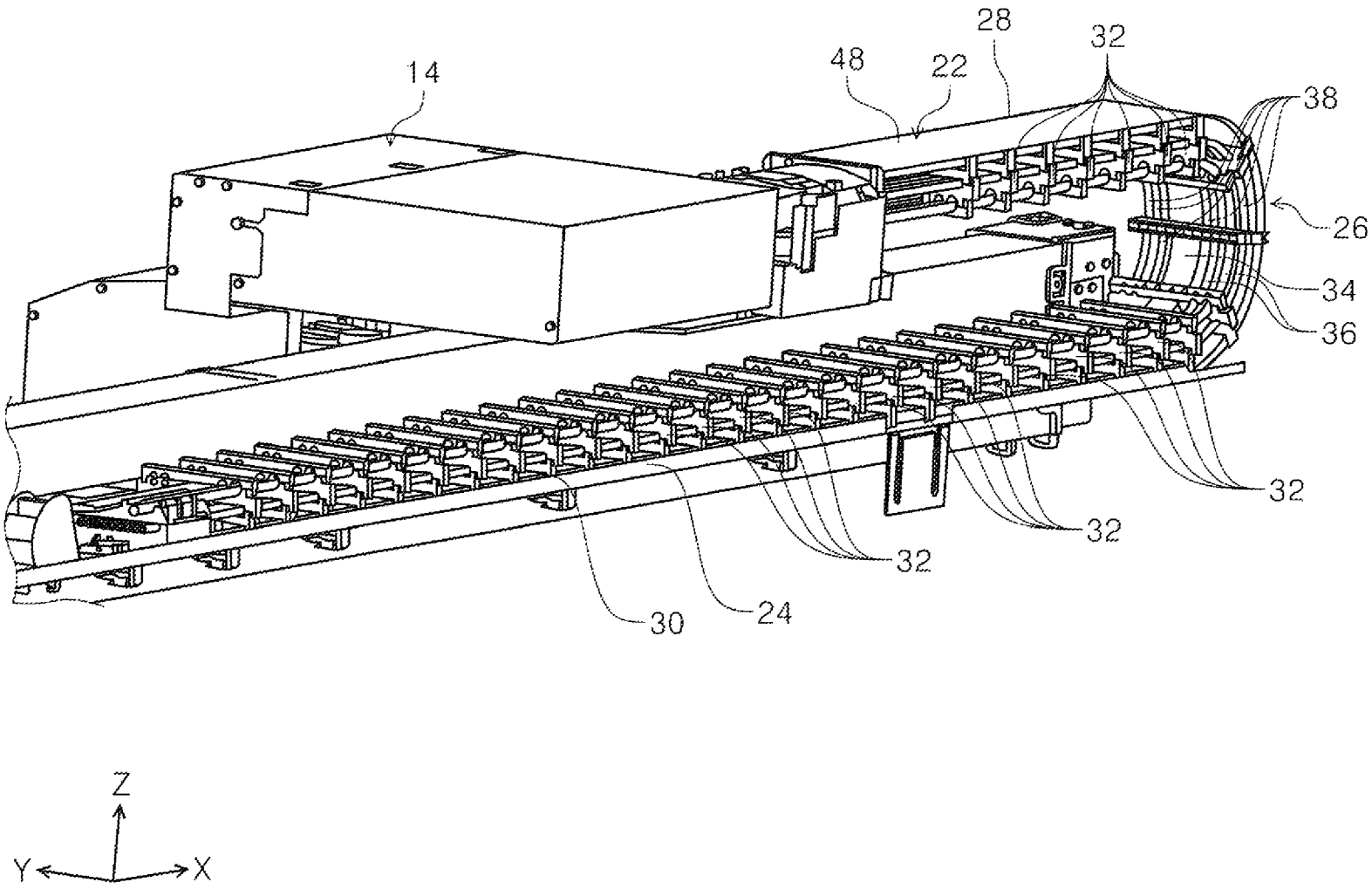
FIG. 3 is a perspective view of the carriage, the cable clamp member, and the clamp member supporting portion according to the first exemplary embodiment as viewed from the back face side in the depth direction of the device.

FIG. 1 is a schematic view of a printer according to the invention, FIG. 2 is a perspective view of a carriage, a cable clamp member, and a clamp member supporting portion according to the first exemplary embodiment as viewed from the front face side in a depth direction of a device, and FIG. 3 is a perspective view of the carriage, the cable clamp member, and the clamp member supporting portion according to the first exemplary embodiment as viewed from the back face side in the depth direction of the device.

Figure 4:
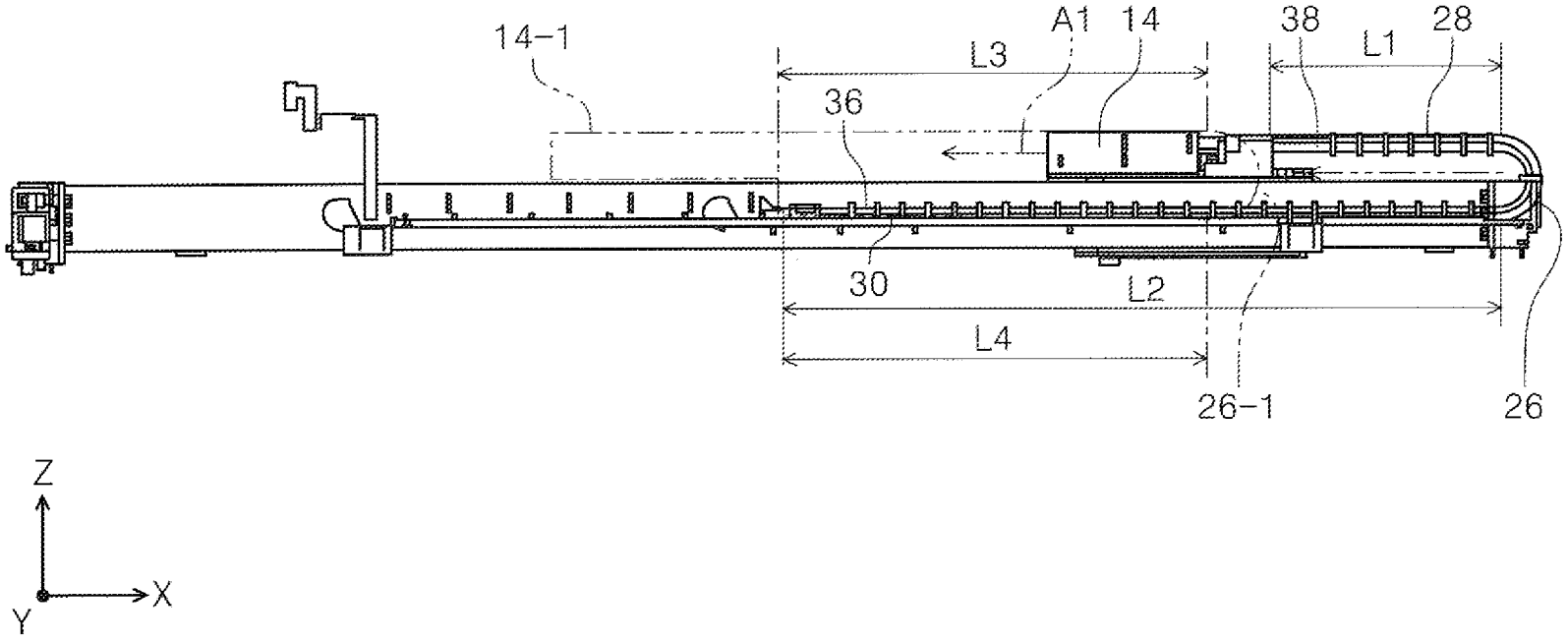
FIG. 4 is a rear view illustrating a state variation of the cable clamp member associated with movement of a carriage according to the first exemplary embodiment.
Figure 5:
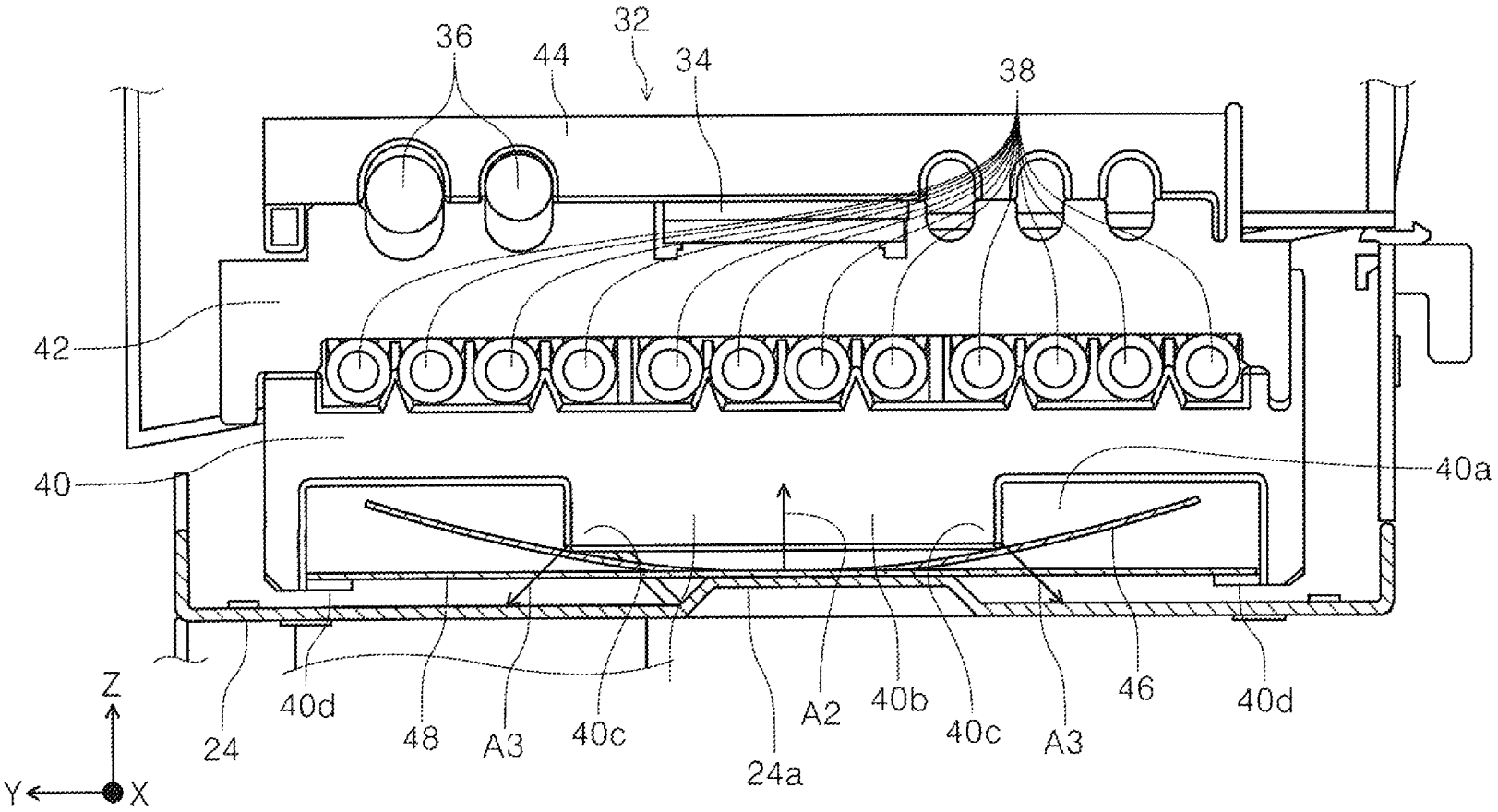
FIG. 5 is a cross-sectional view of the cable clamp member supported by the clamp member supporting portion.
Figure 6:
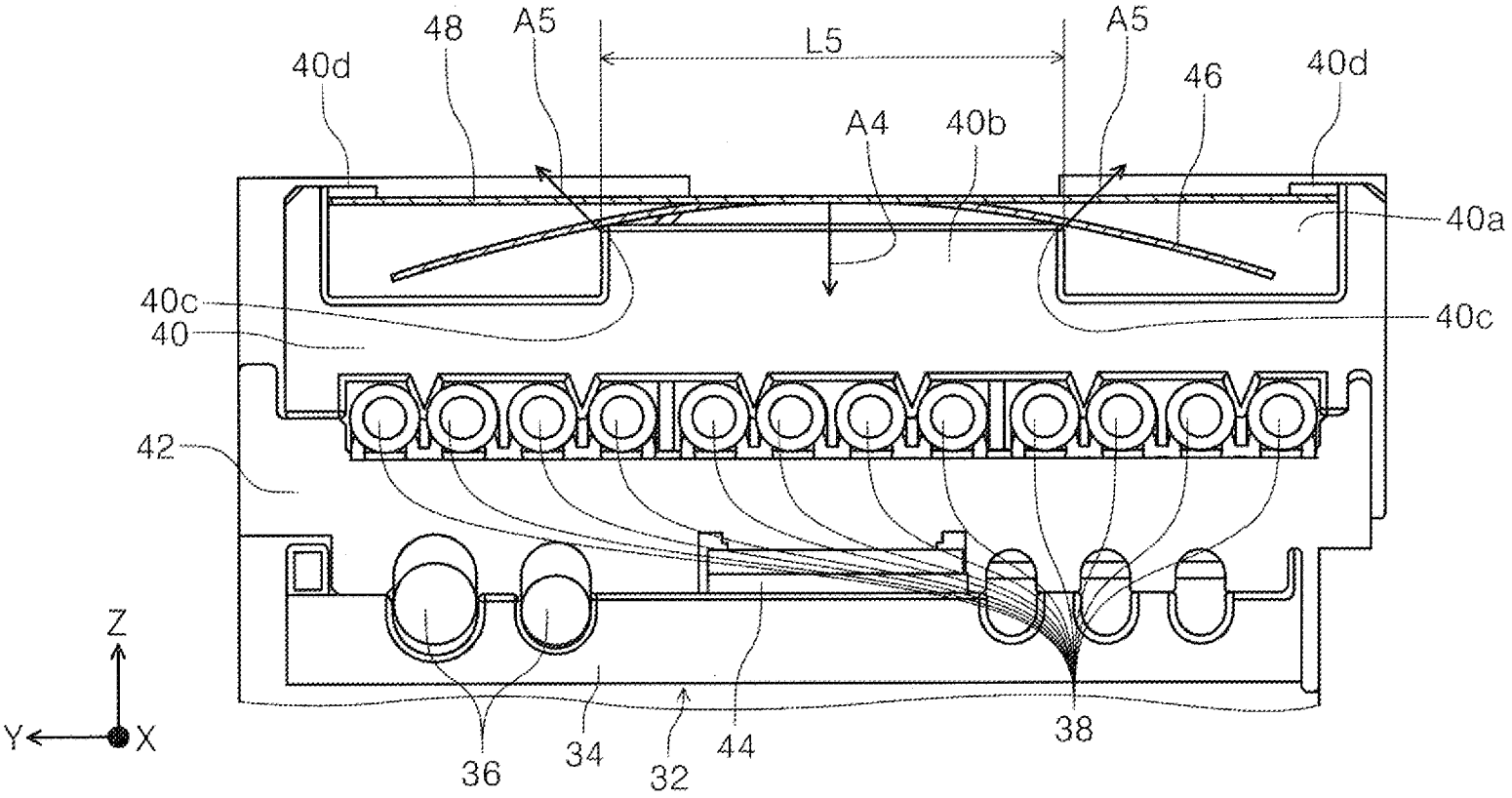
FIG. 6 is a cross-sectional view of a cable clamp member in a path extending from the carriage to a turned curved portion in the cable clamp member.

FIG. 4 is a rear view illustrating a state variation of the cable clamp member associated with movement of a carriage according to the first exemplary embodiment, FIG. 5 is a cross-sectional view of the cable clamp member supported by the clamp member supporting portion, and FIG. 6 is a cross-sectional view of the cable clamp member in a path extending from the carriage to a turned curved portion in the cable clamp member.

Figure 7:
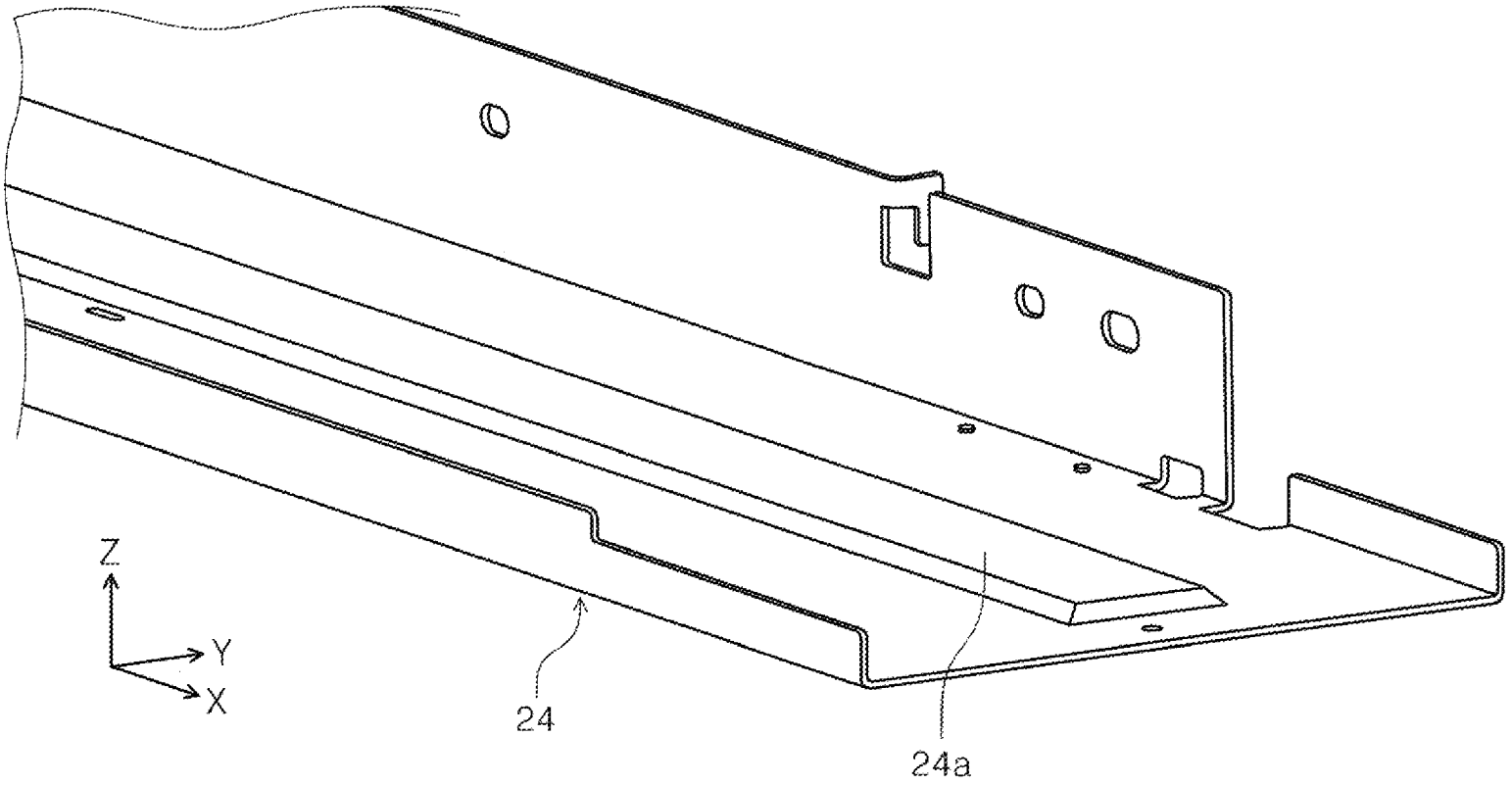
FIG. 7 is a perspective view of the clamp member supporting portion according to the first exemplary embodiment.
Figure 8:
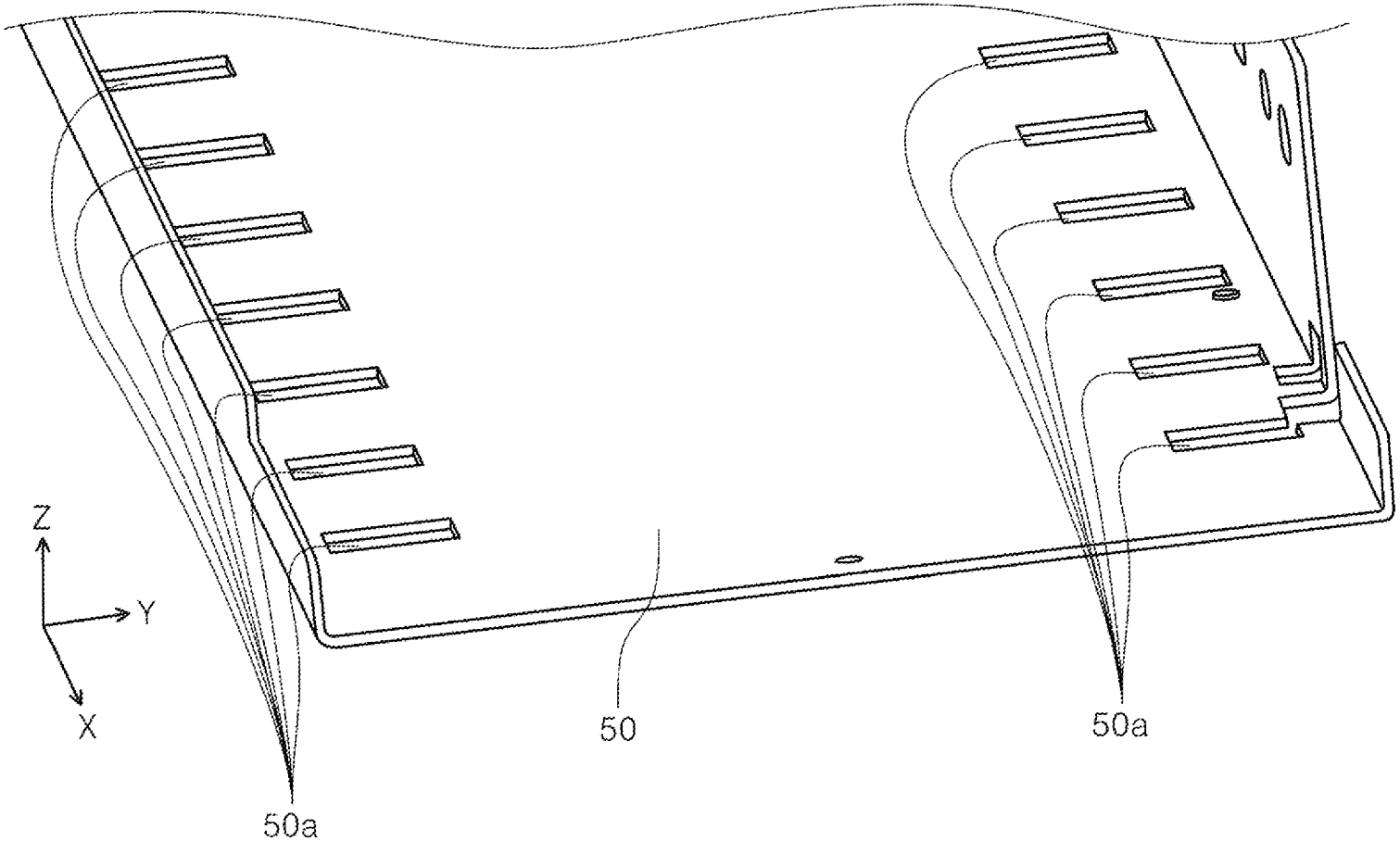
FIG. 8 is a perspective view of a clamp member supporting portion according to a second exemplary embodiment.
Figure 9:
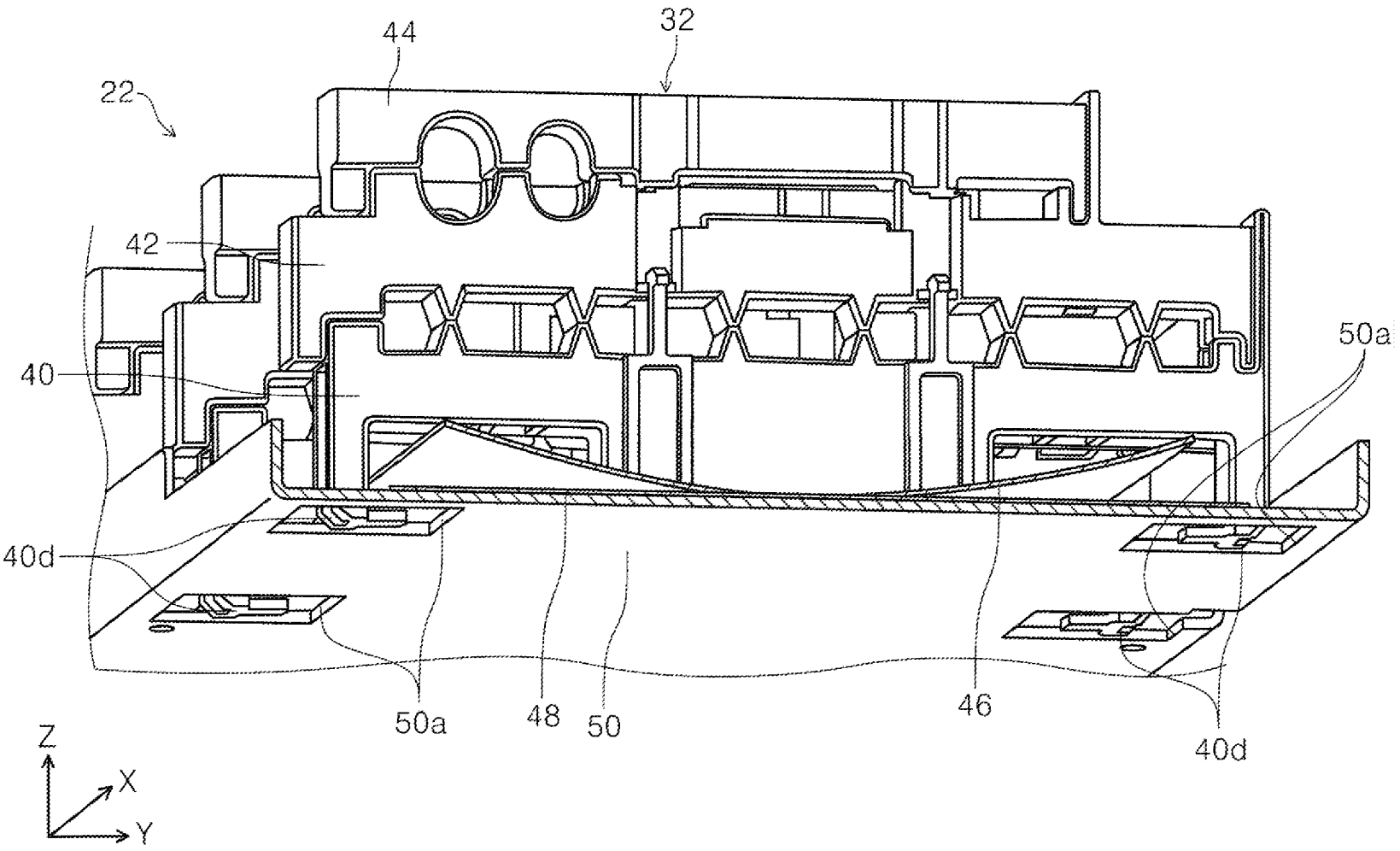
FIG. 9 is a perspective view illustrating a state where the clamp member supporting portion according to the second exemplary embodiment supports a cable clamp member.

FIG. 7 is a perspective view of the clamp member supporting portion according to the first exemplary embodiment, FIG. 8 is a perspective view of a clamp member supporting portion according to a second exemplary embodiment, and FIG. 9 is a perspective view illustrating a state where the clamp member supporting portion according to the second exemplary embodiment supports a cable clamp member.

Moreover, in an X-Y-Z coordinate system illustrated in each of the figures, an X direction represents a device width direction and also represents a medium width direction, a Y direction represents a medium transfer direction in a recording device, and a Z direction represents a device height direction. Note that, in each of the figures, a +X direction side is defined as a first direction, a −X direction side is defined as a second direction, a Y-axis direction is defined as an intersecting direction intersecting the first direction and the second direction, a +Y direction side is defined as the front face side of the device, and a −Y direction side is defined as the back face side of the device.

First Exemplary Embodiment

Overview of Recording Device

With reference to FIG. 1, an ink jet printer 10 (hereinafter, a printer 10) as an example of a recording device according to a first exemplary embodiment will be described.

The printer 10 includes a device body 12. The device body 12 is provided with a carriage 14 movable in the +X-axis direction being the first direction and the −X-axis direction being the second direction. At a bottom portion of the carriage 14, a recording head 16 is provided. A bottom face of the recording head 16 is provided with a plurality of nozzles (not illustrated) configured to discharge ink being a "liquid" toward the −Z direction side.

Moreover, in at least a portion of a movement region of the carriage 14, a medium supporting portion 18 is provided on the −Z direction side of the carriage 14. Although illustration is omitted in FIG. 1, a medium supplying unit configured to supply a medium P is provided on the back face side (the −Y-axis direction side) in a device depth direction of the device body 12. As an example, the medium supplying unit is configured to supply a roll-shaped medium to the medium supporting portion 18, or is configured to supply a cut sheet.

The medium P delivered by the medium supplying unit (not illustrated) to the medium supporting portion 18 is subjected to recording performed by the recording head 16 in a state where the medium P is located in a region facing the recording head 16. Subsequently, the medium P is ejected by an ejecting roller 20 provided on the downstream side of the medium supporting portion 18 to the front face side (the +Y direction side) in the device depth direction of the device body 12.

Regarding Configurations of Carriage, Cable Clamp Member, and Clamp Member Supporting Portion With reference to FIG. 2 to FIG. 7, configurations of the carriage 14, a cable clamp member 22, and a clamp member supporting portion 24 will be described.

In FIG. 2 to FIG. 4, the cable clamp member 22 is attached to an end portion on the back face side of the carriage 14. The cable clamp member 22 extends in the +X-axis direction being the first direction from the end portion on the back face side of the carriage 14, and is curved and also turned toward the −Z direction side to form a turned curved portion 26.

Further, the cable clamp member 22 extends from the turned curved portion 26 in the −X-axis direction being the second direction.

In the first exemplary embodiment, a path portion extending in the +X-axis direction from the carriage 14 to the turned curved portion 26 in the cable clamp member 22 is defined as a first path portion 28, and a path portion extending in the −X-axis direction from the turned curved portion 26 is defined as a second path portion 30.

As illustrated in FIG. 4, the carriage 14 is configured to be movable in the X-axis direction. In FIG. 4, when the carriage 14 moves in a direction of arrow A1 (the −X-axis direction), the cable clamp member 22 also deforms to follow movement of the carriage 14. Specifically, in association with the movement of the carriage 14, the turned curved portion 26 also moves in the movement direction of the carriage 14. Note that in FIG. 4, a two-dot chain line portion denoted by reference sign 14-1 indicates a position of the carriage 14 located after the movement, while a two-dot chain line portion denoted by reference sign 26-1 indicates a position of the turned curved portion 26 located after the movement.

In FIG. 4, assuming that before the carriage 14 is moved, a length in the X-axis direction of the first path portion 28 before the movement of the carriage 14 is defined as L1 and a length in the X-axis direction of the second path portion 30 before the movement of the carriage 14 is defined as L2, a relationship of L2>L1 holds. When the carriage 14 moves in the direction of arrow A1, in association with the movement of the turned curved portion 26, a portion of the second path portion 30 is to pass the turned curved portion 26 to constitute a portion of the first path portion 28. Accordingly, the length of the first path portion 28 becomes L3, greater than L1, and the length of the second path portion 30 becomes L4, less than L2. Note that the length L3 of the first path portion 28 after the movement of the carriage 14 becomes greater than the length L4 of the second path portion 30.

The configuration of the cable clamp member 22 will further be described with reference to FIG. 2, FIG. 3, FIG. 5, and FIG. 6. The cable clamp member 22 includes a plurality of clamp parts 32 at an interval in the X-axis direction. The plurality of clamp parts 32 are each attached to the coupling member 34 having a belt-like shape and extending in the X-axis direction. Accordingly, the plurality of clamp parts 32 are coupled to one another to bend. In the first exemplary embodiment, the plurality of clamp parts 32 accommodate a plurality of cables 36 and a plurality of tubes 38.

In each of the plurality of cables 36, one end is electrically coupled to the recording head 16 via the carriage 14, and the other end is electrically coupled to a control unit and a power supply unit (not illustrated) provided in the device body 12. In the first exemplary embodiment, two cables 36 are provided. As an example, one of the two cables 36 is configured to supply electric power from the power supply unit (not illustrated) to the carriage 14, and in turn, to the recording head 16. Moreover, the other of the two cables 36 is configured to transmit and receive an electric signal to and from the control unit (not illustrated).

In each of the plurality of tubes 38, one end is coupled to the carriage 14 to enable supply of ink to the recording head 16, and the other end is coupled to an ink tank (not illustrated) provided in the device body 12. The tube 38 is configured as a flow path through which ink being a liquid is supplied from the ink tank (not illustrated) to the recording head 16.

Note that, in the first exemplary embodiment, the cable 36 and the tube 38 have flexibility, and can deform in accordance with the deformation of the cable clamp member 22 to follow the movement of the carriage 14.

As illustrated in FIG. 5 and FIG. 6, the clamp part 32 includes a first clamp member 40, a second clamp member 42, and a third clamp member 44. In the first exemplary embodiment, the first clamp member 40 is engaged with the second clamp member 42, and the third clamp member 44 is engaged with the second clamp member 42. In the first exemplary embodiment, the tubes 38 are disposed to be arranged side by side in the Y-axis direction between the first clamp member 40 and the second clamp member 42 engaged with each other. The cables 36 are disposed to be arranged side by side in the Y-axis direction between the second clamp member 42 and the third clamp member 44 engaged with each other.

In FIG. 5, a spring member accommodating portion 40*a* is formed on the −Z direction side of the first clamp member 40. In the first exemplary embodiment, a convex portion 40*b* protruding in the −Z direction is formed in the central portion in the Y-axis direction of the spring member accommodating portion 40*a*. Both end portions in the Y-axis direction of the convex portion 40*b* constitute abutment portions 40*c* abutting on a spring member 46 to be described below.

The spring member 46 is disposed inside the spring member accommodating portion 40*a*. The spring member 46 extends along the path of the cable clamp member 22, and is configured as a leaf spring disposed on the outer peripheral side (on the outer peripheral side of the turned curved portion 26) of the cable clamp member 22. The spring member 46 is formed of a metal material, as an example. In the first exemplary embodiment, the spring member 46 is disposed inside the spring member accommodating portion 40*a* in a shape formed by warping a central portion in the Y-axis direction toward the −Z direction side, specifically, by curving the central portion in the Y-axis direction toward the −Z direction side. Further, the spring member 46 having the curved shape is in contact with the abutment portions 40*c* formed at the convex portion 40*b* of the spring member accommodating portion 40*a*.

Both end portions in the Y-axis direction of the first clamp member 40 protrude toward the −Z direction side, specifically, toward the −Z direction side of the convex portion 40*b* of the spring member accommodating portion 40*a*, and at each of leading ends of both the end portions, a sheet member retaining portion 40*d* having a hook-like shape is formed.

In FIG. 5, a sheet member 48 is disposed on the −Z direction side of the spring member 46. Specifically, the sheet member 48 extends along the path of the cable clamp member 22, and is disposed on the outer peripheral side (on the outer peripheral side of the turned curved portion 26) of the spring member 46 disposed along the cable clamp member 22. The sheet member 48 is formed of, as an example, a flexible resin material. Both end portions in the Y-axis direction of the sheet member 48 are retained by the sheet member retaining portion 40*d*. In the first exemplary embodiment, the sheet member 48 is in contact with the spring member 46 curved toward the −Z direction side at the central portion in the Y-axis direction, as an example.

In the first exemplary embodiment, both the end portions in the Y-axis direction of the sheet member 48 are retained by the sheet member retaining portion 40*d*, and thus, disengagement of the sheet member 48 from the first clamp member 40, and in turn, from the cable clamp member 22 can be prevented.

In FIG. 7, the clamp member supporting portion 24 extends in the X-axis direction, and is configured as a guide member configured to guide the cable clamp member 22. In the first exemplary embodiment, a protruding portion 24*a* protruding toward the +Z direction side is formed, as an example, at the central portion in the Y-axis direction of the clamp member supporting portion 24. The protruding portion 24*a* also extends in the X-axis direction.

Again with reference to FIG. 5, a state where the clamp part 32 is supported by the clamp member supporting portion 24, that is, the second path portion 30 of the cable clamp member 22, will be described. When a portion of the turned curved portion 26 of the cable clamp member 22 comes into contact with the clamp member supporting portion 24 in association with the movement of the carriage 14, the clamp part 32 is supported by the protruding portion 24*a* of the clamp member supporting portion 24 via the sheet member 48 and the spring member 46.

In this state, when the sheet member 48 comes into contact with the protruding portion 24*a* of the clamp member supporting portion 24, the sheet member 48 being in contact with the protruding portion 24*a* depresses the spring member 46 in the +Z-axis direction (see arrow A2). Here, the spring member 46 deformed in a curved shape is disposed inside the spring member accommodating portion 40*a* in a state where the spring member 46 is in contact with the abutment portions 40*c* formed at the convex portion 40*b* of the spring member accommodating portion 40*a*. When the sheet member 48 being in contact with the protruding portion 24*a* depresses the spring member 46 in the +Z-axis direction (see arrow A2), the abutment portions 40*c* depress the spring member 46, as illustrated by arrow A3, to restore the spring member 46 having a curved shape into a state where the spring member 46 is flat. In this state, the spring member 46 generates reaction force (spring force) in a direction opposite to the depressing force to push the sheet member 48 back toward the −Z direction side.

Owing to this spring force, when the clamp part 32 is supported by the clamp member supporting portion 24, specifically, when one location in the Y-axis direction of the spring member 46, that is, in the first exemplary embodiment, the central portion is supported by the clamp member supporting portion 24, a shock occurring when the clamp part 32 comes into contact with the clamp member supporting portion 24 is alleviated, and a contact noise can be reduced. In the first exemplary embodiment, the sheet member 48 having flexibility is disposed between the spring member 46 and the clamp member supporting portion 24, and thus, when the spring member 46 made of metal is supported by the clamp member supporting portion 24, the sheet member 48 alleviates a shock, and a contact noise can be reduced. Note that the above-described one location means one point at which the spring member 46 is supported, and also means a portion at which the spring member 46 is supported by the clamp member supporting portion 24 in a state where the spring member 46 elastically deforms in the Y-axis direction along the clamp member supporting portion 24.

Further, the sheet member 48 is brought into contact with the protruding portion 24*a* of the clamp member supporting portion 24, and thus, the clamp part 32 can be supported by the clamp member supporting portion 24 in a state where the clamp part 32 is floated toward the +Z direction side with respect to the clamp member supporting portion 24. Specifically, the clamp part 32 can be supported by the clamp member supporting portion 24 without causing the sheet member retaining portion 40*d* of the clamp part 32 to come into contact with the clamp member supporting portion 24. As a result, when the clamp part 32 is supported by the clamp member supporting portion 24 in association with the movement of the carriage 14, the sheet member retaining portion 40*d* does not come into contact with the clamp member supporting portion 24, and thus, generation of a contact noise can be reduced. Accordingly, a running noise (undesired sound) consecutively generated by contact of the sheet member retaining portion 40*d* with the clamp member supporting portion 24 in association with the movement of the carriage 14 can be reduced.

In the first exemplary embodiment, the clamp part 32, and in turn, the spring member 46 are supported, partially in the Y-axis direction, specifically, at the central portion in the Y-axis direction via the sheet member 48 by the clamp member supporting portion 24. Accordingly, the clamp part 32 can be supported in a stable posture in the Y-axis direction. That is, support in the Y-axis direction of the clamp part 32 being inclined toward the +Y direction side or toward the −Y direction side with respect to the clamp member supporting portion 24 can be suppressed. As a result, the inclination of the clamp part 32 toward the +Y direction side or toward the −Y direction side to cause contact of the clamp part 32 with the clamp member supporting portion 24 can be suppressed, and a contact noise (undesired sound) generated when the clamp part 32 comes into contact with the clamp member supporting portion 24 can be suppressed.

Then, in FIG. 6, a state where the clamp part 32 is located at the first path portion 28 in the cable clamp member 22 will be described. A configuration of the clamp part 32 is the same as the configuration in FIG. 6 merely reversed in the Z-axis direction, and thus, description of the clamp part 32 will be omitted.

In the state of FIG. 6, the first clamp member 40, the second clamp member 42, the third clamp member 44, the plurality of cables 36, and the plurality of tubes 38 constituting the clamp part 32 weigh, via the sheet member 48, on the spring member 46. Specifically, the sheet member 48 depresses the spring member 46 in the −Z direction (the direction of arrow A4).

When the sheet member 48 depresses the spring member 46 in the −Z axial direction (see arrow A4), the abutment portions 40*c* depress the spring member 46 as illustrated by arrow A5 to restore the spring member 46 having a curved shape into a state where the spring member 46 is flat. In this state, the spring member 46 generates reaction force (spring force) in a direction opposite to the depressing force to push the sheet member 48 back toward the +Z direction side.

This spring force is exerted to act against the depressing force applied via the sheet member 48 to the spring member 46. As a result, the spring force of the spring member 46 can act against the weights of the first clamp member 40, the second clamp member 42, the third clamp member 44, the plurality of cables 36, and the plurality of tubes 38. Accordingly, the spring force of the spring member 46 can suppress hanging down in the −Z direction of the clamp part 32 due to its own weight, and can prevent occurrence of an incident such as crushing of the tube 38.

Moreover, as illustrated in FIG. 6, in the first exemplary embodiment, a distance between the abutment portions 40*c* of the convex portion 40*b* of the first clamp member 40 is set to L5. For example, a magnitude of the spring force generated in the spring member 46 varies depending on the distance between the abutment portions 40*c*. Therefore, the distance between the abutment portions 40*c* is set to a suitable distance, and thus, the spring force of the spring member 46 can act against the weights of the first clamp member 40, the second clamp member 42, the third clamp member 44, the plurality of cables 36, and the plurality of tubes 38, and the distance between the abutment portions 40*c* is set to generate spring force greater than these weights. Therefore, hanging down in the −Z direction of the cable clamp member 22 can be reduced more reliably.

Modifications of First Exemplary Embodiment (1) Although in the first exemplary embodiment, the configuration in which, in the clamp part 32, the sheet member 48 is disposed on the outer side of the spring member 46 (the side opposite to the contact side with the first clamp member 40) is employed, a configuration, for example, in which both end portions in the Y-axis direction of the spring member 46 curved are retained by the first clamp member 40 can be employed, and thus, the spring member 46 can be retained by the clamp part 32 without providing the sheet member 46, and disengagement of the spring member 46 from the clamp part 32 can be prevented. Moreover, the spring member 46 can be caused to elastically deform along the Z-axis direction, and when the spring member 46 comes into contact with the clamp member supporting portion 24, the spring member 46 can generate spring force, and thus, a contact noise between the clamp part 32 and the clamp member supporting portion 24 can be reduced.

(2) Although in the first exemplary embodiment, the configuration in which the cable clamp member 22 is directly coupled to the carriage 14 is employed, a configuration, for example, in which the cable clamp member 22 is indirectly coupled to the carriage 14 via an elastic member or the like may be employed.

(3) Although in the first exemplary embodiment, the spring member 46 is formed in a curved shape, as an alternative to this configuration, the spring member 46 may have a shape bent at the central portion.

Second Exemplary Embodiment

A second exemplary embodiment will be described with reference to FIG. 8 and FIG. 9. In the second exemplary embodiment, a configuration of a clamp member supporting portion differs from the configuration of the clamp member supporting portion 24 in the first exemplary embodiment. Specifically, a clamp member supporting portion 50 according to the second exemplary embodiment differs from the clamp member supporting portion 24 according to the first exemplary embodiment in that, no protruding portion 24*a* is provided, and instead, a relief portion is formed at each of both end portions in the Y-axis direction. Note that, in FIG. 9, illustration of cables 36 and tubes 38 is omitted.

In FIG. 8, the clamp member supporting portion 50 extends in the X-axis direction, and is configured as a guide member configured to guide a cable clamp member 22. In the second exemplary embodiment, a relief portion 50*a* is formed at each of both end portions in the Y-axis direction of the clamp member supporting portion 50. As an example, the relief portion 50*a* is configured as a through hole passing through the clamp member supporting portion 50. A plurality of the relief portions 50*a* are provided by a predefined distance in the X-axis direction.

In the second exemplary embodiment, the predefined distance means a distance set to the same distance as a distance between a plurality of clamp parts 32 constituting the cable clamp member 22.

As illustrated in FIG. 9, the relief portions 50*a* are provided at the same interval as the interval in the X-axis direction between the clamp parts 32, in a state where the clamp parts 32 of the cable clamp member 22 are supported by the clamp member supporting portion 50, and thus, sheet member retaining portions 40*d* at both end portions in the Y-axis direction of a first clamp member 40 enter the relief portions 50*a*. As a result, contact of the sheet member retaining portions 40*d* with the clamp member supporting portion 50 can be avoided. Accordingly, a contact noise generated when the sheet member retaining portions 40*d* come into contact with the clamp member supporting portion 50 can be reduced. As a result, generation of a running noise due to consecutive contact of the sheet member retaining portions 40*d* with the clamp member supporting portion 50 in deformation of the cable clamp member 22 following a carriage 14 in association with movement of the carriage 14 can be suppressed.

Modifications of Second Exemplary Embodiment

Although in the second exemplary embodiment, the relief portion 50*a* is configured as a through hole, as an alternative to this configuration, each sheet member holding portion 40*d* may be configured as a recess having a size preventing contact of the sheet member holding portion 40*d* with the clamp member supporting portion 50.

Moreover, although in the second exemplary embodiment, the cable clamp member 22 and the clamp member supporting portions 24 and 50 according to the invention are applied to an ink jet printer as an example of a recording device, these components can also generally be applied to any other liquid ejecting device.

Here, the liquid ejecting device means a recording device such as a printer, a copying machine, and a facsimile in which an ink jet-type recording head is used and ink is discharged from the recording head to perform recording on a medium for recording, and also means a device in which instead of the ink, a liquid corresponding to application of the liquid is ejected from a liquid ejecting head commensurate with the ink jet-type recording head onto a medium for ejection commensurate with the medium for recording to cause the liquid to adhere to the medium for ejection.

Examples of the liquid ejecting head include, in addition to the above recording head, a color material ejecting head used for manufacturing a color filter of a liquid crystal display or the like, an electrode material (conductive paste) discharging head used for forming an electrode of an organic EL display, a face emitting display (FED), or the like, a bioorganic material ejecting head used for manufacturing a biochip, and a sample ejecting head as a precision pipette.

Note that the invention is not intended to be limited to the above examples, and various variations can be made within the scope of the invention as described in the claims. It goes without saying that such variations also fall within the scope of the invention.

This application claims priority under 35 U.S.C. § 119 to Japanese Patent Application No. 2018-056579, filed Mar. 23, 2018. The entire disclosure of Japanese Patent Application No. 2018-056579 is hereby incorporated herein by reference.

What is claimed is:

1. A recording device comprising:

a carriage that includes a recording head configured to discharge a liquid onto a medium to perform recording, and that is movable in a first direction and in a second direction that is a direction opposite to the first direction;

a cable through which an electric signal is transmitted to and received from the recording head;

a tube through which the liquid is supplied to the recording head;

a cable clamp member that is configured to accommodate the cable and the tube and rotatably couple a plurality of tubular pieces to one another to bend the plurality of tubular pieces, that is coupled to the carriage, and that extends from the carriage in the first direction and passes a turned curved portion formed by being curved and turned around to extend from the turned curved portion in the second direction;

a spring member provided along the cable clamp member; and a clamp member supporting portion extending along the first direction and the second direction and configured to support the cable clamp member via the spring member, wherein the spring member is configured to generate spring force in a direction in which hanging down of the cable clamp member at a path portion extending from the carriage to the turned curved portion of the cable clamp member is suppressed, and the spring member is partially in contact with the clamp member supporting portion at a path portion extending in the second direction from the turned curved portion, in an intersecting direction intersecting the first direction and the second direction.

2. The recording device according to claim 1, wherein the spring member forms a leaf spring, and a central portion with respect to both end portions in the intersecting direction of the spring member is curved in a direction away from the cable clamp member.

3. The recording device according to claim 1, comprising a sheet member provided along the spring member in the first direction and in the second direction, wherein when the cable clamp member is supported by the clamp member supporting portion, the sheet member is located between the spring member and the clamp member supporting portion.

4. The recording device according to claim 3, wherein a sheet member retaining portion configured to retain the sheet member is provided at each of both end portions in the intersecting direction of the cable clamp member, and in a state where both end portions in the intersecting direction of the sheet member are retained by the sheet member retaining portion, the sheet member is in contact with the spring member between both the end portions of the sheet member.

5. The recording device according to claim 1, wherein the clamp member supporting portion is configured to support the cable clamp member at a central portion in the intersecting direction.

6. The recording device according to claim 5, wherein a protruding portion protruding toward the cable clamp member is formed at the central portion of the clamp member supporting portion.

7. The recording device according to claim 1, wherein at each of both end portions in the intersecting direction of the clamp member supporting portion, a relief portion is formed to avoid contact with the cable clamp member.

8. The recording device according to claim 7, wherein a plurality of the relief portions are provided at intervals in the first direction and in the second direction.

9. The recording device according to claim 1, wherein the cable clamp member includes a spring member accommodating portion configured to receive the spring member, a convex portion protruding in a direction away from the cable clamp member is formed at a central portion in the intersecting direction of the spring member accommodating portion, and both end portions in the intersecting direction of the convex portion come into contact with the spring member.

* * * * *